US006585129B2

(12) United States Patent
Moody et al.

(10) Patent No.: US 6,585,129 B2
(45) Date of Patent: Jul. 1, 2003

(54) NAPKIN DISPENSER FOR INTERFOLDED NAPKINS WITH BAFFLED DISPENSING APERTURE

(75) Inventors: John R. Moody, Neenah, WI (US); Jean-Louis Neveu, Colmar (FR); Craig D. Yardley, Deer Park, IL (US)

(73) Assignee: Georgia-Pacific Corporation, Atlanta, GA (US)

( * ) Notice: Subject to any disclaimer, the term of this patent is extended or adjusted under 35 U.S.C. 154(b) by 54 days.

(21) Appl. No.: 09/812,495

(22) Filed: Mar. 20, 2001

(65) Prior Publication Data

US 2002/0040913 A1 Apr. 11, 2002

Related U.S. Application Data

(60) Provisional application No. 60/239,310, filed on Oct. 10, 2000.

(51) Int. Cl.[7] ..... A47K 10/24
(52) U.S. Cl. ..... 221/44; 221/59
(58) Field of Search ..... 221/44, 52, 56, 221/59, 63, 4 B, 241; D6/518

(56) References Cited

U.S. PATENT DOCUMENTS

| | | | | | |
|---|---|---|---|---|---|
| 1,901,243 | A | * | 3/1933 | Horwitt | 221/59 |
| 2,541,933 | A | * | 2/1951 | Nail | 221/48 |
| 2,852,158 | A | * | 9/1958 | Jones et al. | 221/59 |
| 3,036,729 | A | * | 5/1962 | Asman | 221/48 |
| 3,369,699 | A | * | 2/1968 | Enloe et al. | 221/48 |
| 3,456,843 | A | * | 7/1969 | Planner | 221/63 |
| 4,065,028 | A | | 12/1977 | Merila | 221/36 |
| 4,094,442 | A | | 6/1978 | Radek | 221/59 |
| 4,311,252 | A | | 1/1982 | Hope, Jr. et al. | 221/57 |
| 4,329,001 | A | * | 5/1982 | Filipowicz et al. | 221/59 |
| 4,343,415 | A | | 8/1982 | Radek | 221/63 |
| 4,679,703 | A | | 7/1987 | De Luca | 221/52 |
| 4,768,679 | A | * | 9/1988 | Matsui | 221/48 |
| 4,838,454 | A | * | 6/1989 | Salzmann et al. | 221/59 |
| 4,953,747 | A | * | 9/1990 | Wenkman et al. | 221/56 |
| 5,884,804 | A | * | 3/1999 | King | 221/48 |
| 5,950,863 | A | | 9/1999 | Shutz et al. | 221/46 |
| 6,003,723 | A | | 12/1999 | Morand | 221/44 |
| D430,764 | S | | 9/2000 | Conran et al. | D6/518 |

FOREIGN PATENT DOCUMENTS

| | | | | |
|---|---|---|---|---|
| GB | 2235431 A | * | 3/1991 | 221/63 |
| WO | WO 97/09918 | | 3/1997 | A47K/10/41 |
| WO | WO 98/22009 | | 5/1998 | A47K/10/42 |

* cited by examiner

*Primary Examiner*—Kenneth W. Noland
(74) *Attorney, Agent, or Firm*—Michael W. Ferrell

(57) ABSTRACT

A napkin dispenser for dispensing a stack of interfolded napkins includes an enclosure with a top, bottom, sidewalls, a back wall and a dispensing wall provided with a dispensing aperture spanning along its major axis at least the transverse dimension of an interfolded napkin to be dispensed therethrough as well as a pressure carriage slidably mounted in the enclosure provided with biasing means. The enclosure and pressure carriage are configured to receive a stack of interfolded napkins between the dispensing wall and the pressure carriage, whereas the dispensing means urge the carriage and thus the interfolded napkins towards the dispensing wall. The improved dispensing aperture of the napkin dispenser defines a narrow elongated slit about its central portion and a pair of open areas about its terminal portions. In another aspect of the invention there is provided a napkin dispenser insert for providing the geometry of the dispensing aperture to a conventional napkin dispenser provided with an aperture of relatively uniform width.

24 Claims, 4 Drawing Sheets

NAPKIN DISPENSER FOR INTERFOLDED NAPKINS WITH BAFFLED DISPENSING APERTURE

CLAIM OF PRIORITY

This non-provisional patent application claims the benefit of Provisional Application Serial No. 60/239,310, of the same title, which was filed on Oct. 10, 2000.

TECHNICAL FIELD

The present invention relates generally to napkin dispensers and more particularly to a napkin dispenser with a modified dispensing aperture to prevent the unwanted dispensing of bunches of napkins.

BACKGROUND

Napkin dispensers are well known in the art. See for example U.S. Pat. No. 4,838,454 of Salzmann et al.; U.S. Pat. No. 4,311,252 of Hope, Jr. et al.; and U.S. Pat. No. 4,065,028 of Merila. One problem and indeed one of the major disadvantages of napkin dispensers of the class generally utilized to dispense interfolded napkins is the tendency for a user to grasp and remove an entire group of napkins, wastefully discarding what is not used. This problem is sometimes believed to be aggravated by bunching at the dispensing aperture and various means have been attempted to reduce or eliminate the problem of wastage of a plurality of napkins.

There is disclosed for example, in U.S. Pat. No. 4,679,703 to De Luca a device from preventing napkins from bunching at the dispensing opening in a napkin dispenser including a pair of pressure relief rods along the upper and lower portions of the dispenser face plate. The purpose of the rods is to relieve pressure between the face plate and the center portion of the napkin stack. Accordingly, the friction between each napkin is substantially reduced, thereby permitting individual napkins to be withdrawn from the dispenser without displacing napkins remaining in the stack.

There is disclosed in U.S. Pat. No. 4,343,415 to Radek a napkin dispenser configured for disposition on a table or counter including a top axis opening for loading and removing napkins. The opening is generally rectangular or may taper slightly from one end to the other. A salient feature is at the edges of the opening extend outwardly providing a relatively narrow peripheral arcuate flange or lip around the opening, the effect of which is to lead a napkin gently outwardly without likelihood of damaging the napkin. The design is reported to promote extraction of a single napkin at a time, resulting in substantial economy of operations.

In U.S. Pat. No. 4,094,442 also to Radek there is disclosed another napkin dispenser with a generally rectangular opening with a concavely arcuate edge on one side from which the napkins are extracted. Two opposed sides of the opening are provided with a pair of relatively narrow spring biased leaves resiliently extendable into the container to facilitate loading, the free edges of the leaves being longitudinally gently oblique and widening toward the arcuate edge of the opening. The various features are reported to contribute toward convenient extraction of the napkin without damage.

The various techniques employed in the prior art for promoting extraction of a single napkin from an interfolded napkin dispenser are believed to have met with rather limited success, perhaps due to the relative complexity of the designs and the unpredictability of the consumer's behavior. In accordance with the present invention there is provided a uniquely configured dispensing aperture which restricts the ability of a napkin consumer from inserting his or her fingers into the interior of the interfolded napkin dispenser.

SUMMARY OF INVENTION

There is provided in accordance with the present invention a napkin dispenser for dispensing a stack of interfolded napkins including an enclosure with a top, bottom, sidewalls, a back wall and a dispensing wall provided with a dispensing aperture spanning along its major axis at least the transverse dimension of an interfolded napkin to be dispensed therethrough; a pressure carriage slidably mounted in said enclosure provided with biasing means; the enclosure and pressure carriage are configured to receive a stack of interfolded napkins between the dispensing wall and the pressure carriage such that the biasing means urge the carriage and thus the stack of interfolded napkins towards the dispensing wall. The dispensing aperture defines a narrow elongated slit about its central portion and a pair of open areas about its terminal portions. The narrow elongated slit typically spans more than about 50 percent of the transverse dimension of an interfolded napkin being dispensed therethrough. The narrow elongated slit would still more typically span more than about 70 percent of the transverse dimension of an interfolded napkin being dispensed therethrough. The elongated slit generally has an opening width of from about 1/16 inch to about 5/8 inch with from about 1/8 inch to about 1/2 inch being typical. Particularly preferred are embodiments wherein the narrow elongated slit has an opening width of from about 1/4 inch to about 3/8 inch.

At either end of the narrow elongated slit of the dispensing aperture are terminal portions having an open area span (i.e. open diameter) of at least about 1/2 inch. The terminal portions preferably have an open area span of at least about 3/4 inch and most preferably an open area span of at least about 1 inch. This open area span is required since the interfolded napkin dispensers are frequently replenished by a technician who fails to interfold the added napkins with the napkins already in the dispenser. Thus, when one interfolded stack charged to the dispenser is finished, the last napkin does not frictionally engage the next stack of napkins which has been loaded into the container so that the napkin being dispensed fails to draw the next napkin through the aperture. In this situation the user must have an ability to insert his or her fingers into the napkin dispenser in order to draw out the next napkin. By restricting this open geometry to the terminal portions the chances of a consumer grasping a plurality of bunched napkins is very much reduced.

In another aspect of the present invention there is provided a novel retraining insert for use in a napkin dispenser of the class including an enclosure with a top, bottom, sidewalls, a back wall and a dispensing wall provided with a dispensing aperture of relatively uniform dispensing width spanning along its major axis at least the transverse dimension of an interfolded napkin to be dispersed therethrough. The napkin dispenser typically includes a pressure carriage slidably mounted in the enclosure provided with biasing means wherein the enclosure and pressure carriage are configured to receive the stack of interfolded napkins between the dispensing wall and the pressure carriage such that the biasing means urge the pressure carriage and thereby the stack of interfolded napkins toward the dispensing wall. The napkin retaining insert is provided for modulating the dispensing width of the dispensing aperture. The insert is mounted on the dispensing wall and projects into the dispensing aperture of uniform width and as positioned is configured in dimension to define a narrow elongated slit about the central portion of the dispensing aperture as well as a pair of open areas about the terminal portions of the dispensing aperture. The open portions function as noted above, that is, wherein a stack of napkins which is not interfolded with the preceding stack loaded into the dispenser can be grasped so that the next collection of interfolded napkins can be dispensed without opening the napkin dispenser. Generally the napkin dispenser insert is of suitable dimensions to define the aperture characteristics referred to above. Typically the insert is adhesively mounted on the interior of the dispensing wall and is substantially planar with first and second parallel sides adjacent arcuate sides therebetween, such that the arcuate sides will cooperate with the aperture in the dispensing wall to define the open terminal areas. In such embodiments the first parallel side is typically longer than the second parallel side and the longer or first parallel side is secured to the interior of the dispensing wall.

In general, the present invention relates to an improved dispensing aperture in a napkin dispenser including means for defining a restricted central portion of the aperture wherein the restricted central portion is operable to impede the withdrawal of more than a single napkin. The restricted central portion is adjacent two terminal open areas which allow a user to insert his or her fingers into the interior of the enclosures, whereas the restricted central portion prevents a user from inserting his or her fingers into the interior of the enclosure and easily grasping a large plurality of napkins. Even if a consumer grasps a plurality of napkins through an open terminal portion of the aperture, the central restricted portion will still operate to impede withdrawal of more than a single napkin from the dispenser. The unique geometry of the aperture of the present invention has the further advantage of better distributing the pressure over the napkins in the stack since there is more contact area in the dispensing wall. Also, in some embodiments a baffle plate extends into the top interior of the dispenser, tending to equalize the pressure applied to the bottom portion of the interfolded napkin stack by a spring. The front dispensing wall of the present invention typically includes a baffle plate which may or may not be integrally formed with the front wall and generally includes arcuate terminal portions. In some embodiments, an insert baffle plate is adhesively or otherwise secured in an aperture of relatively uniform width, for example, an elongated oval structure, to define the unique aperture geometry of the invention.

In some embodiments the second parallel side will have a matching radius of curvature of the dispensing aperture (typically its lower lip) so that the dispensing slit is of relatively uniform dimensions thereacross. So also, the second parallel side may project outwardly from the first parallel side particularly where the dispensing wall is generally convex in construction. Here again, the particular geometry will define a dispensing width of relatively uniform dimensions. The retaining insert may be made of any suitable material such as metal, plastic, filled plastic and so forth, but is perhaps preferably made of an amorphous plastic material such as polycarbonate. These and other features of the invention will become better understood through the description and drawings which follow.

BRIEF DESCRIPTION OF DRAWINGS

The invention is described in detail below in connection with the various figures in which.

DETAILED DESCRIPTION

Figure 1:
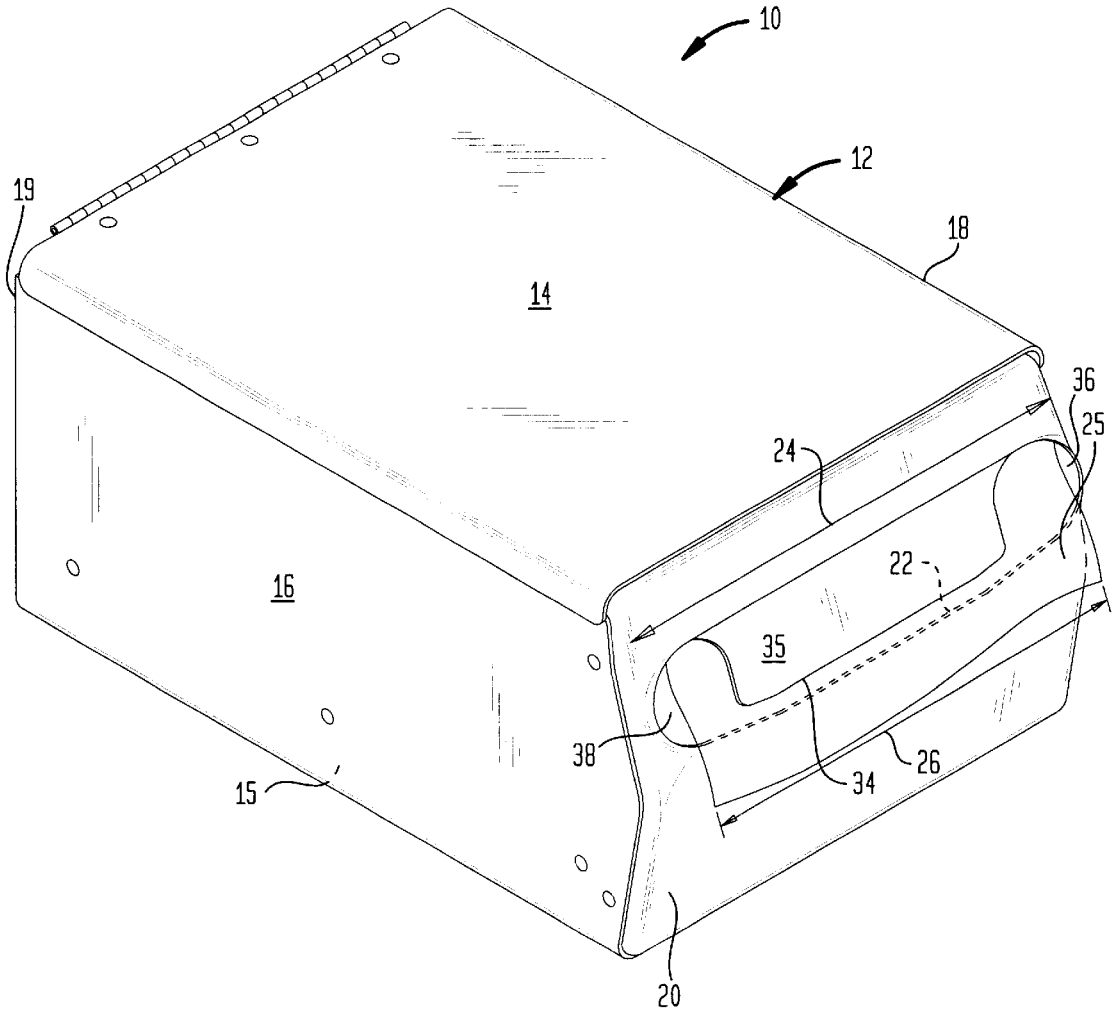
FIG. 1 is a perspective view showing a napkin dispenser constructed in accordance with the invention wherein a napkin is shown projecting from the dispensing aperture.

The invention is described in detail below with reference to the figures for purposes of illustration only. Modification to various embodiments illustrated within the spirit and scope of the present invention, which is set forth in the appended claims, will be readily apparent to one of skill in the art.

There is shown in FIGS. 1 through 4 a napkin dispenser instructed in accordance with the present invention. Napkin dispenser 10 generally includes an enclosure 12 with a top 14, a bottom 15, a pair of sidewalls 16 and 18, a back wall 19, as well as a dispensing wall 20. The dispensing wall defines a dispensing aperture 22 having a major axis, that is, the length or span 24 of the opening, which is generally larger than the interfolded napkins to be dispensed. As can be seen from FIG. 1, a napkin 25 has a transverse dimension 26 which is drawn through the dispensing aperture 22.

Top 14 may be hingedly secured to the back wall to provide for loading a stack 29 of interfolded napkins. Stack 29 may be a stack of single folded or multi-folded napkins as are well known in the art. In the interior of dispenser 10 there is provided a pressure carriage 27 which is slidably mounted about a pair of mounting rails 30, 32 as can be most clearly seen in FIGS. 2 and 3.

Figure 2:
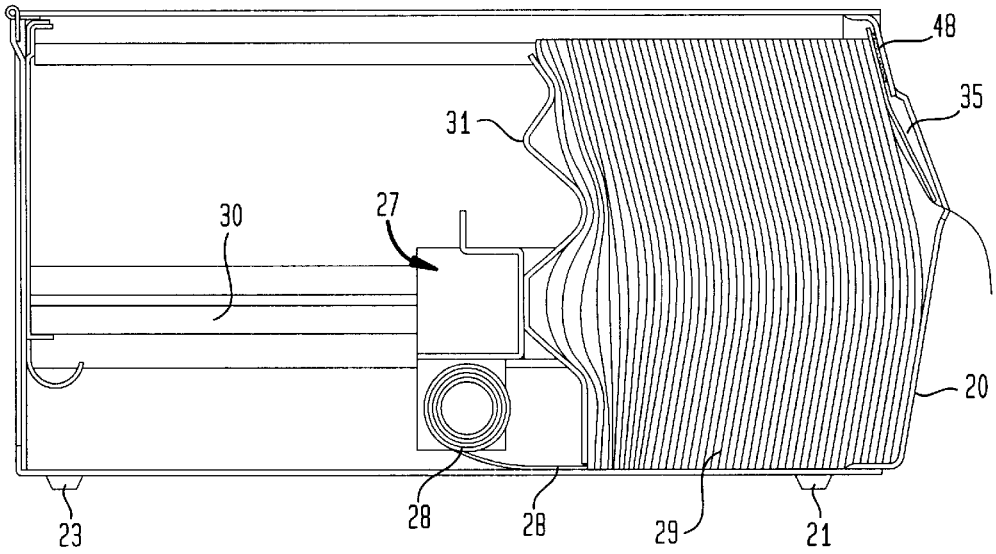
FIG. 2 is a side view in elevation and section of the napkin dispenser of FIG. 1 with a stack of interfolded napkins loaded therein.
Figure 3:
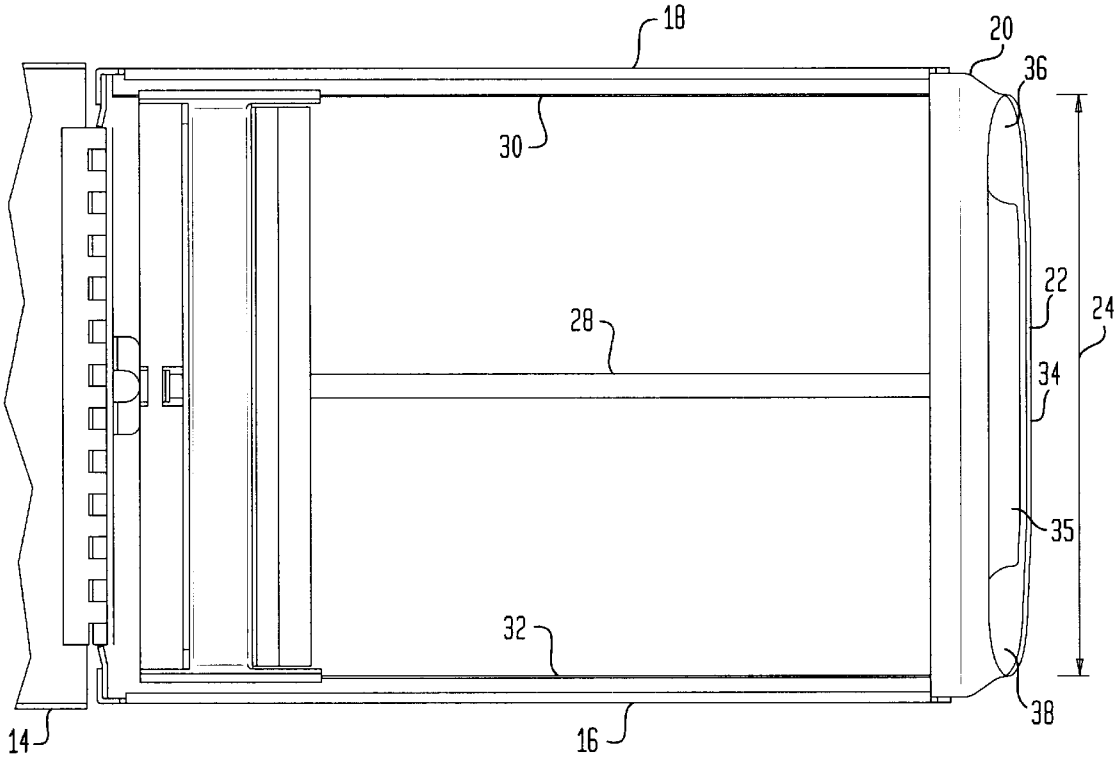
FIG. 3 is a top plan view showing the illustrating napkin dispenser of FIG. 1 in open (loading) condition without a stack of napkins.

FIG. 2 is a side view in elevation and section illustrating the interior of dispenser 10 while FIG. 3 is a top plan view showing the interior of dispenser 10 with top 14 open and pressure carriage 27 fully retracted so that a stack of napkins such as stack 29 in FIG. 2 can be loaded into the dispenser.

The dispenser further includes a spring 28 in the form generally of a reel which is operative to urge pressure carriage 27 and thus stack 29 towards dispensing wall 20.

In the embodiments shown dispensing wall 20 is generally convex outwardly as shown. Moreover this convexity may be in the vertical as well as transverse direction depending on the particular geometry employed. Likewise, pressure carriage 27 is shown provided with a sinuous plate 31 which is a preferred mode of distributing the pressure load about the stack of napkins 29 as will be appreciated by one of skill in the art. Bottom 15 which is optionally provided with coasters, such as coasters 21, 23 which may be rubber or any suitable material for placing on a counter top or table. In general the inventive napkin dispenser is fabricated of metal, plastic or any other suitable material. In the particular embodiments shown the enclosure is generally constructed of metal, whereas the insert (more fully described below) is fabricated of plastic.

In general the napkin dispenser operates by way of loading a stack 29 of napkins between pressure carriage 27 and dispensing wall 20. The stack of napkins is interfolded, preferably single folded, but multi-folded if so desired, and the stack is urged towards wall 20 by way of spring 28. It is desired that the napkins be dispensed one at a time. Thus in accordance with the invention there is provided a baffle plate 35 which cooperates with dispensing wall 20 to define a narrow elongated slit 34 about the central portion of dispensing aperture 22. On either side of narrow elongated slit 34 there is provided a pair of relatively open areas 36 and 38. In general aperture 22 is of a length or major axis 24 of a length greater than the transverse dimension 26 of a napkin 25 to be dispensed therethrough. The narrow elongated slit operates, in part, to prevent a consumer from inserting his or her fingers or hand into the interior of the napkin dispenser and grab a plurality of napkins leading to waste. On the other hand, the relatively open areas 36 and 38 provide a means for a consumer to grasp a napkin and restart a stack of interfolded napkins once a protruding napkin edge has been lost. This frequently occurs since a food technician might load a new stack of interfolded napkins behind a stack already in the dispenser yet fail to interfold the two stacks. Thus, the leading stack will not frictionally pull the first napkin out of the following stack once it is exhausted. Thus a consumer will find on occasion that there is no protruding napkin to pull the next one. In this instance the open area will require a significant amount of effort for a consumer to restart the napkins through the slit. But in any event this may be accomplished and the narrow slit will still require that only a single napkin is dispensed at a time.

The dispensing aperture in accordance with the invention is generally of the dimensions shown, that is, having an elongated slit with open areas on either end. The elongated slit has a width 40 (shown most clearly in FIG. 4), preferably fairly uniform, of from about 1/16 inch to about 5/8 inch. Typically the width of the slit would be from about 1/8 to about 1/2 inch and preferably from about 1/4 inch to about 3/8 inch. The terminal portions have a span 42 of at least about 1/2 inch. By span of the open area as used herein it is generally meant that the open area has a minimum dimension or span of about 1/2 inch. Typically the terminal portions of the dispensing aperture will have an open area span or minimum dimension of at least about 3/4 inches. The span on the embodiment illustrated is shown as 42 in FIG. 4. Preferably the span of the terminal open areas is at least about 1 inch.

Figure 4:
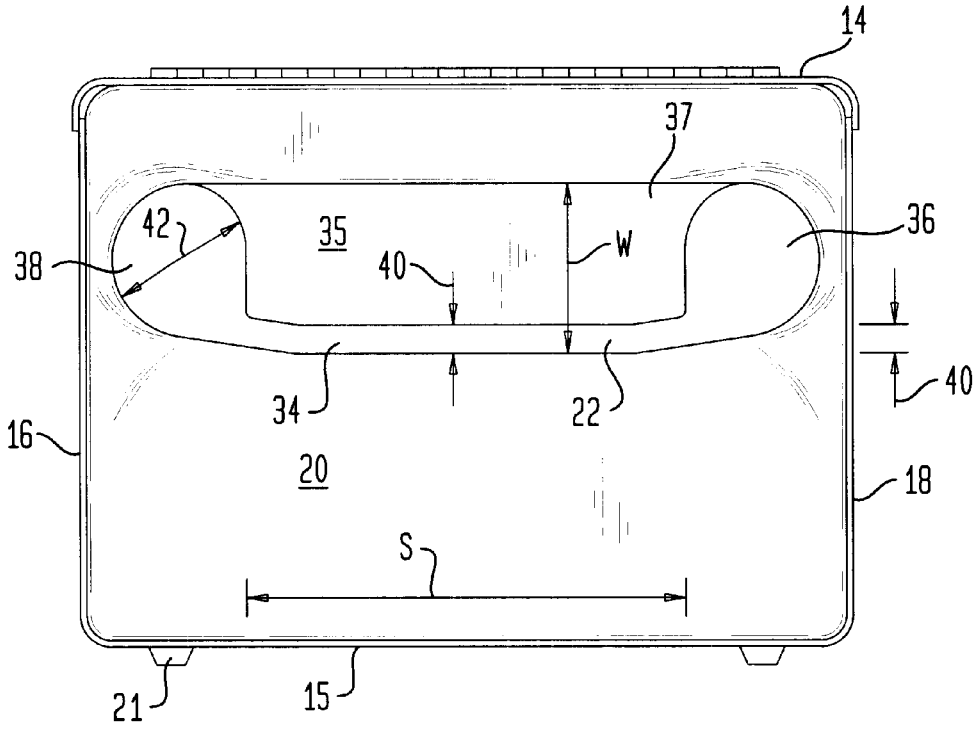
FIG. 4 is a front view in elevation of the napkin dispenser of FIG. 3.

With respect to elongated slot 34, the terminology span as used herein refers to the length, S, of the slot as shown in FIG. 4.

Figure 5:
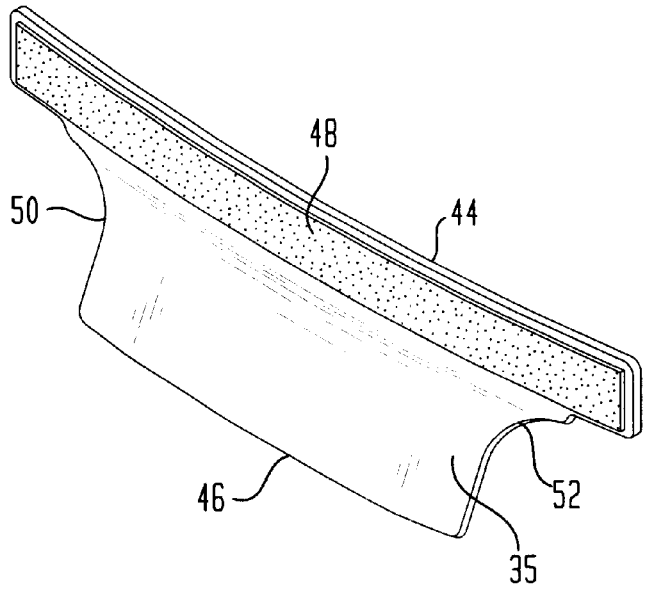
FIG. 5 is a view in perspective of an insert for a napkin dispenser constructed in accordance with the present invention.

A napkin dispenser in accordance with the invention may be constructed of various materials and parts. One advantage of the present invention is that a baffle plate generally of the geometry shown as plate 35 may be integrally formed with plate 20 or retrofit into existing napkin dispensers. For example, there is shown in FIGS. 5 through 8, a baffle plate 35 provided with an adhesive strip 48 of foamed adhesive or other suitable material, having a top edge 44 and a bottom edge 46. When fit into a napkin dispenser having a relatively uniform dispensing aperture such as elongated oval aperture 37 shown in FIG. 4, having a width, W, of perhaps 1 1/4 inch or so the baffle plate operates to give the dispensing aperture the dimensions and general geometry referred to above. That is to say, when the plate of FIG. 5 is mounted into a napkin dispenser of FIGS. 1–4 having a dispensing aperture of 1/4 inch width, uniformly there across the baffle plate of FIG. 5 will configure the dispensing aperture to the dimensions shown in FIGS. 1 and 4 and discussed above.

Figure 6:
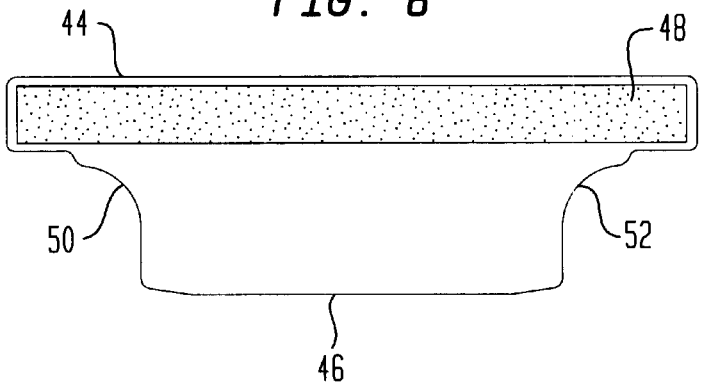
FIG. 6 is a top plan view of the insert for a napkin dispenser shown in FIG. 5.
Figure 7:
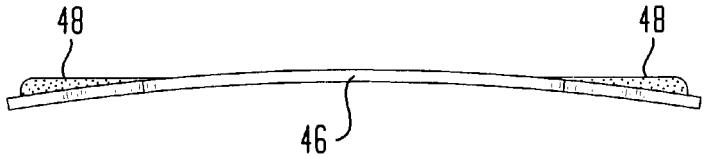
FIG. 7 is a view along the lower edge of the napkin dispenser insert of FIG. 5.
Figure 8:
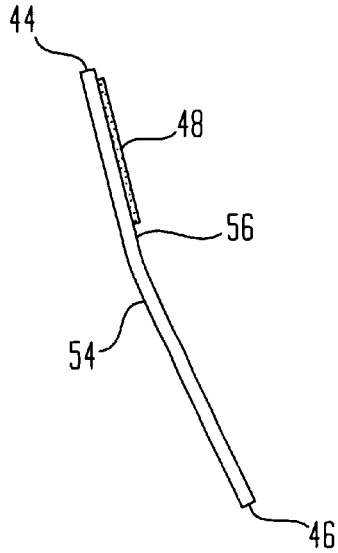
FIG. 8 is an end view illustrating the napkin dispenser insert of FIGS. 5, 6 and 7.

The same is accomplished by mounting a baffle plate such as insert 35 by way of adhesive strip 48 to the interior of wall 20 of FIG. 2. The insert 35 has the added benefit that the extra dimensions of the baffle plate 35 and the adhesive strip 48 will apply pressure to the stack 29 of napkins and will also help prevent bunching of the napkins. So also, the extra area along the front wall provided by the baffle will help equalize pressure on the stack; whereas the extra dispenser at the top will counteract extra pressure applied by spring 28 at the bottom of the stack. In general when retrofitting a napkin dispenser provided with relatively uniform dispensing width with a plate 35 such as shown in FIGS. 5 through 7, the plate will generally have a longer side along edge 44 and a shorter side along bottom side 46 as well as a pair of arcuate portions 50 and 52 which will cooperate with the aperture defined by the dispensing wall to define the open areas. In general in such a configuration the top edge 44 of insert 35 would be longer than its parallel side 46. The top side, of course, is secured to the dispensing wall 20. In general, the napkin dispenser wall may have a radius of curvature which is preferably matched with a radius of curvature of an insert such as 35, such that the dispensing width, particularly the dispensing slit 34 will remain of relatively uniform dimensions over its width. In particular as will be appreciated from FIGS. 1 through 4 an outwardly convex dispensing wall would generally require an insert having a outwardly projecting lower side 46 as shown in FIG. 8. The insert for retrofitting the napkin holder may be made of any suitable material such as metal, plastic, filled plastic, and so forth, but is preferably made from an amorphous plastic such as polycarbonate.

It will be appreciated from FIGS. 1 through 8 that plate 35 is of complex shape, being angled along a lateral edge 54 such that the plate protrudes outwardly when mounted on plate 20 by way of strip 48 as can be seen particularly in FIGS. 2 and 8. So also, plate 35 has generally a longitudinal convexity towards side 56 as should be noted from FIGS. 5 and 7 especially. With this geometry, the baffle may be inserted into an existing napkin dispenser and will apply a gentle contacting force to stack 29 consistent with the shape of plate 20 in order to promote the dispensing of napkins one at a time.

While the invention has been described in detail, various modifications within the spirit and scope of the present invention, defined in the appended claims, will be readily apparent to one of the skill in the art.

What is claimed is:

1. A napkin dispenser for dispensing a stack of interfolded napkins comprising:

(a) an enclosure including a top, a bottom, sidewalls, a back wall and a dispensing wall provided with a dispensing aperture spanning along its major axis at least the transverse dimension of an interfolded napkin to be dispensed therethrough;

(b) a pressure carriage slidably mounted in said enclosure provided with biasing means;

said enclosure and pressure carriage being configured to receive said stack of interfolded napkins between said dispensing wall and said pressure carriage wherein said biasing means urge said carriage and said stack of interfolded napkins forward said dispensing wall; and wherein further said dispensing aperture defines a narrow elongated slit about its central portion and a pair of open areas about its terminal portions, said narrow elongated slit spanning more than about 50% of the transverse dimension of an interfolded napkin being dispensed therethrough and having an opening width of from about 1/16 inch to about 5/8 inch so that the dispensing aperture impedes the ability of a napkin consumer from inserting his or her fingers into the interior of the interfolded napkin dispenser.

2. The napkin dispenser according to claim 1, wherein said narrow elongated slit spans more than about 70% of the transverse dimension of an interfolded napkin being dispensed therethrough.

3. The napkin dispenser according to claim 1, wherein said narrow elongated slit has an opening width of from about 1/8 inch to about 1/2 inch.

4. The napkin dispenser according to claim 3, wherein said narrow elongated slit has an opening width of from about 1/4 inch to about 3/8 inch.

5. The napkin dispenser according to claim 1, wherein said terminal portions have an open area span of at least about 1/2 inch.

6. The napkin dispenser according to claim 5, wherein said terminal portions have an open area span of at least about 3/4 inch.

7. The napkin dispenser according to claim 6, wherein said terminal portions have an open area span of at least about 1 inch.

8. In a napkin dispenser for dispensing a stack of interfolded napkins of the class including an enclosure with a top, bottom, sidewalls, a back wall and a dispensing wall provided with a dispensing aperture of relatively uniform dispensing width spanning along its major axis at least the transverse dimension of an interfolded napkin to be dispensed therethrough and a pressure carriage slidably mounted in said enclosure provided with biasing means wherein the enclosure and pressure carriage are configured to receive said stack of interfolded napkins between said dispensing wall and said pressure carriage and the biasing means urge the pressure carriage and thereby the stack of interfolded napkins toward the dispensing wall, a napkin retaining insert for modulating the dispensing width of said dispensing aperture, said insert being mounted on said dispensing wall and projecting into said dispensing aperture of uniform width and being positioned, configured and dimensioned to define a narrow elongated slit about the central portion of said dispensing aperture and a pair of open areas about the terminal portions of the dispensing aperture.

9. The napkin retaining insert according to claim 8, wherein said narrow elongated slit spans more than about 50% of the transverse dimension of an interfolded napkin being dispenses therethrough.

10. The napkin retaining insert according to claim 9, wherein said narrow elongated slit spans more than about 70% of the transverse dimension of an interfolded napkin being dispenses therethrough.

11. The napkin retaining insert according to claim 8, wherein said narrow elongated slit has an opening width of from about 1/16 inch to about 5/8 inch.

12. The napkin retaining insert according to claim 11, wherein said narrow elongated slit has an opening width of from about 1/8 inch to about 1/2 inch.

13. The napkin retaining insert according to claim 12, wherein said narrow elongated slit has an opening width of from about 1/4 inch to about 3/8 inch.

14. The napkin retaining insert according to claim 9, wherein said terminal portions have an open area span of at least about 1/2 inch.

15. The retaining insert according to claim 14, wherein said terminal portions have an open area span of at least about 3/4 inch.

16. The retaining insert according to claim 15, wherein said terminal portions have an open area span of at least about 1 inch.

17. The napkin retaining insert according to claim 8, wherein said insert is adhesively mounted on said dispensing wall.

18. The napkin retaining insert according to claim 8, wherein said insert is substantially planar with first and second parallel sides adjacent arcuate sides between said first and second parallel sides wherein said arcuate sides cooperate with the aperture of said dispensing wall to define said open areas.

19. The napkin retaining insert according to claim 18, wherein said first parallel side is longer than said second parallel side and is secured to said dispensing wall.

20. The napkin retaining insert according to claim 19, wherein said second parallel side has a radius of curvature matching a radius of curvature of said dispensing aperture.

21. The napkin retaining insert according to claim 19, wherein said second parallel side projects outwardly with respect to said first parallel side.

22. The napkin retaining insert according to claim 8, wherein said napkin retaining insert is made of an amorphous plastic material.

23. The napkin retaining insert according to claim 8, wherein said amorphous plastic material is polycarbonate.

24. In a napkin dispenser including an enclosure defining an interior for receiving a stack of interfolded napkins between a biased pressure carriage and a dispensing wall provided with a dispensing aperture, an improved dispensing aperture wherein a baffle plate with arcuate terminal portions is affixed to said dispensing wall with fastening means to define a restricted central portion of said dispensing aperture, said restricted central portion being operable to impede withdrawal of more than a single napkin therethrough and being adjacent terminal portions of relatively open area, said terminal portions of said aperture being configured to allow a user to insert his or her fingers into the interior of said enclosure, whereas said central portion of said dispensing aperture is configured to prevent a user form inserting his or her fingers into the interior of said enclosure.

* * * * *

UNITED STATES PATENT AND TRADEMARK OFFICE

CERTIFICATE OF CORRECTION

PATENT NO. : 6,585,129 B2
DATED : July 1, 2003
INVENTOR(S) : John R. Moody et al.

It is certified that error appears in the above-identified patent and that said Letters Patent is hereby corrected as shown below:

Column 1,
Line 31, change “from” to -- for --;
Line 45, change “at” to -- that --;

Column 2,
Line 51, change “retraining” to -- retaining --;

Column 4,
Line 4, change “illustrating” to -- illlustrated --;
Line 28, change “instructed” to -- constructed --;

Column 6,
Line 46, delete the first instance of “the”;

Column 7,
Line 50, change “dispenses” to -- dispensed --; and
Line 54, change “dispenses” to -- dispensed --;

Column 8,
Line 54, change “form” to -- from --.

Signed and Sealed this

Fourth Day of November, 2003

JAMES E. ROGAN
*Director of the United States Patent and Trademark Office*